US005653356A

United States Patent [19]

Holliday

[11] Patent Number: 5,653,356

[45] Date of Patent: Aug. 5, 1997

[54] CONTAINER

[75] Inventor: Hubert James Holliday, Edlesborough, England

[73] Assignee: Perstorp Form Limited, England

[21] Appl. No.: 506,042

[22] Filed: Jul. 24, 1995

[30] Foreign Application Priority Data

Aug. 1, 1994 [GB] United Kingdom ..... 9415741

[51] Int. Cl.[6] ..... B65D 43/14

[52] U.S. Cl. ..... 220/331; 220/337

[58] Field of Search ..... 220/331, 333, 220/329, 337

[56] References Cited

U.S. PATENT DOCUMENTS

| | | | |
|---|---|---|---|
| 2,338,477 | 1/1944 | Wolters et al. | 220/331 |
| 2,979,223 | 4/1961 | Rideout | 220/331 |
| 4,260,069 | 4/1981 | Juergens | 220/331 |
| 4,467,939 | 8/1984 | Warwick | 220/331 |
| 4,821,902 | 4/1989 | May | 220/331 |

FOREIGN PATENT DOCUMENTS 2503096 10/1982 France .

*Primary Examiner*—Joseph M. Moy

*Attorney, Agent, or Firm*—Fredrikson & Byron, PA

[57] ABSTRACT

A container comprises a box having a base with upstanding side and end walls defining an open top. A lid is mounted on the box, the lid being movable between a closed position, in which the lid covers the open top of the box, and an open position. The lid comprises two substantially identical end portions. Each lid portion is mounted on the box by a hinge to enable it to pivot about an axis defined by the hinges. The hinges are movable relative to the box to permit a sliding movement of each lid portion relative to the box. The lid portions are adapted to be moved to a position in which the lid portions abut each other, the lid portions then serving to cover the open top of the box. The lid portions may be secured together in the abutting condition.

9 Claims, 4 Drawing Sheets

CONTAINER

FIELD OF THE INVENTION

THE PRESENT INVENTION relates to a container, and more particulary relates to a container comprising a box having a lid, then the container may be stacked with further like containers when the lids of the containers are closed, and wherein the container may be stacked with further like containers when the lids of the containers are open.

Various proposals have been made before concerning the provision of boxes provided with lids adapted to stack when the lids are closed and adapted to nest when the lids are open. The present invention seeks to provide an improved container which is simple to manufacture but which also provides a substantial degree of security for items carried within the container.

SUMMARY OF THE INVENTION

According to this invention there is provided a container comprising a box having a base, upstanding side and end walls defining an open top, and a lid mounted on the box, the lid being movable between a closed position in which the lid covers the open top of the box, and an open position, in which the lid is moved from the open top of the box to provide access to the interior of the box, the lid comprising two substantially identical lid portions, each lid portion being mounted on the box by hinge means to enable the lid to pivot about an axis defined by the hinge means, the hinge means being movable relative to the box to permit sliding movement of each lid portion relative to the box, the lid portions being adapted to be moved in a position in which the lid portions abut one another, means being provided for securing the lid portions together in the abutting condition.

Preferably each lid portion is provided with means which, when the lid is in the closed condition, engage co-operating means provided at the top of each side of the box to retain the lid in position.

Conveniently each lid portion is provided, at a position which is adjacent a side wall of the box where the lid is in the closed condition, with a depending flange, the depending flange carrying an inwardly directed lip, and each side wall is provided, in its upper region, with a horizontally outwardly extending flange carrying a depending flange, the lip on the lid being adapted substantially to engage the depending flange on the side wall when the lid is in the closed condition.

Advantageously the means to secure the lid portions together comprise means on each lid portion defining an aperture adapted to be co-aligned with a substantially corresponding aperture provided on the other lid portion, the aperture on one lid portion being accessible from the exterior of the container when the lids are in the closed condition, the aperture on the other lid portion only being accessible from the interior of the container when the lids are in the closed condition, the aligned apertures being adapted to receive securing means.

Preferably each lid portion is provided with a projecting tongue and is also provided with a slot, the projecting tongue on each lid portion being adapted to be received within the slot on the other lid portion when the lid is in the closed condition.

Advantageously each lid portion is provided, at a position opposed to the said projecting tongue, with a slot in the depending flange provided at a position adjacent the side wall of the box when the lid is in the closed condition, the arrangement being such that when the lid of the box is fully open, the lid portions hang substantially vertically adjacent the side walls of the box and if one box is nested into a lower box, the said slot formed in the depending flange of the lid of the one box receives the corresponding tongue of the corresponding lid portion of the lower box.

Conveniently the said hinge elements comprise inwardly projecting means provided on a depending flange provided at each end of each lid portion, the projecting means being received in a transversely extending channel formed in an upper region of the end wall of the box.

Preferably the transversely extending channel has a depressed central region.

Advantageously an upstanding wall is provided on the upper part of each lid portion, the upstanding walls on the lid portions defining, when the lids are closed, an area corresponding to the area of the base of the box.

BRIEF DESCRIPTION OF THE DRAWINGS

In order that the invention may be more readily understood, and so that further features thereof may be appreciated, the invention will now be described, by way of example, with reference to the accompanying drawings in which.

DESCRIPTION OF THE PREFERRED EMBODIMENTS

Figure 1:
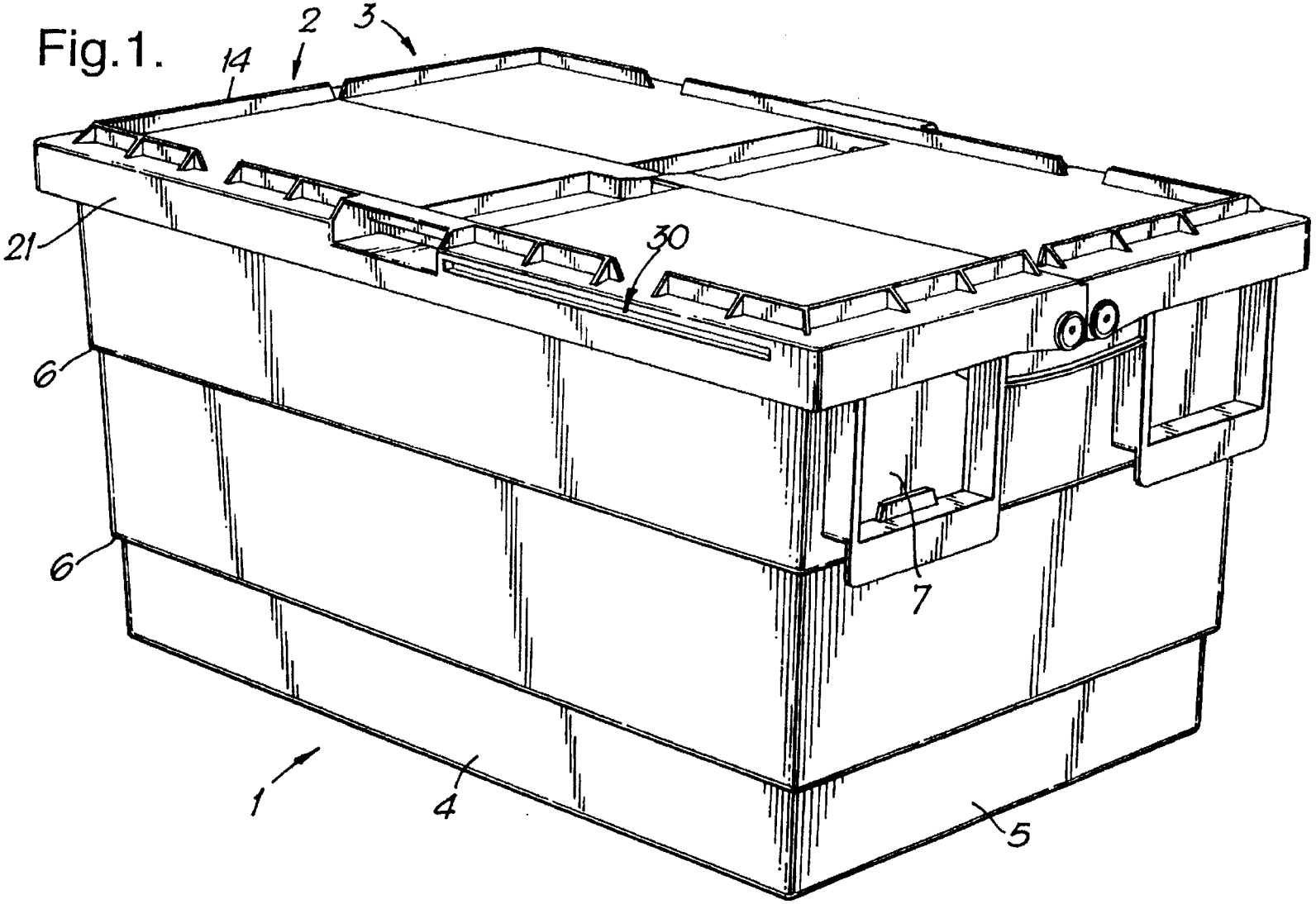
FIG. 1 is a perspective view of a container in accordance with the invention with the lid closed.

Referring to the drawings a container in accordance with the invention comprises a box 1 which is provided with a two-part lid 2,3.

The box 1 comprises a rectangular base having upstanding side walls 4 and upstanding end walls 5.

The side walls 4 and the end walls 5 diverge slightly, with a natural draft angle in view of the fact that the container or box is formed as a moulding of a plastics material. The side walls 4 and the end walls 5 are stepped outwardly as shown at 6, so that the plan area of the box is significantly greater at the top of the box than it is at the base of the box.

The end wall 5 is provided with a ticket pocket 7, access to the ticket pocket 7 being provided through an access slot 8 (see FIG. 2), provided on the interior of the container.

Across the top of the end wall 5, on the exterior of the box, a horizontally extending channel 9 is defined by two spaced apart flanges 10,11. The channel 9 extends across the entire width of the box. The central part of the channel 9 is depressed, as shown in region 12.

Each lid part 2,3 is of identical form. Each lid part defines a substantially rectangular region 13 adapted to extend over one-half of the box. Provided on the planar region is an upstanding wall 14 which, when the lid is in the closed condition, as shown in FIG. 1, lies substantially above the side walls 4 and the end walls 5. The upstanding wall 14 defines an area which corresponds to the area of the base of the container. Thus, when another container is located on top of a first container which has its lid closed, the base of the upper container is retained within the area bounded by the upstanding wall 14.

Figure 3:
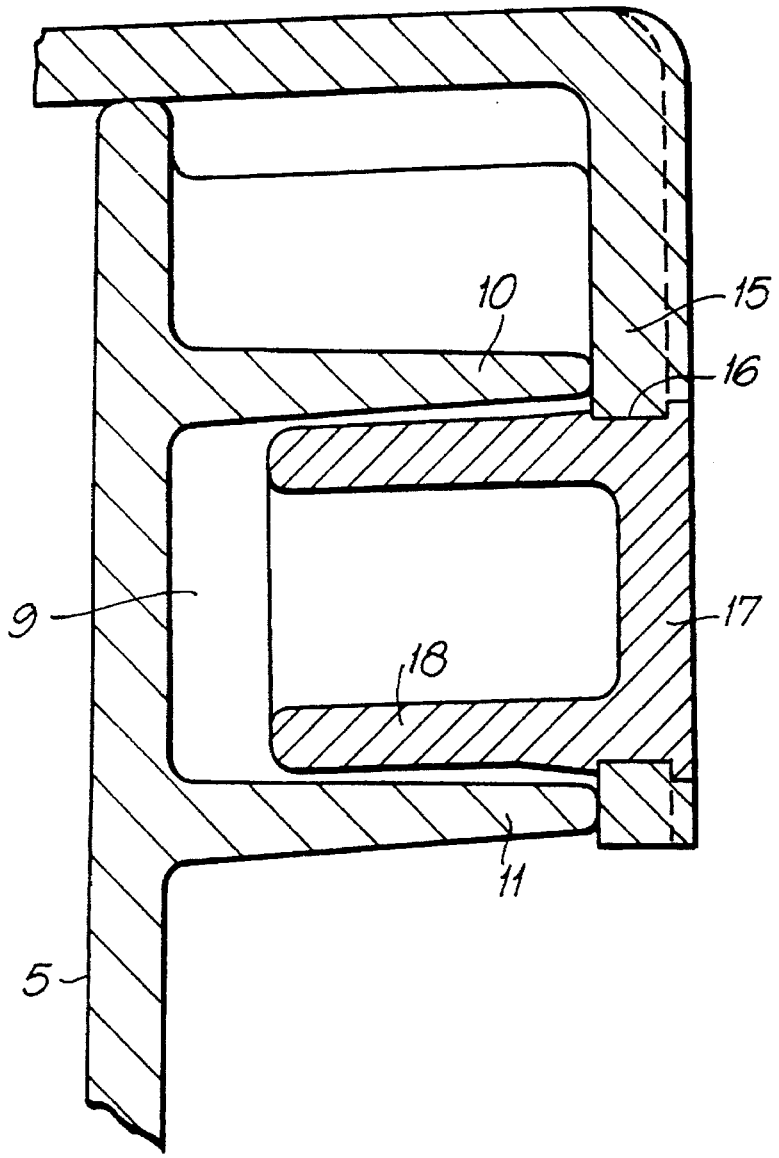
FIG. 3 is an enlarged sectional view illustrating the pivotal connection between the lid and the box.

Adjacent the end walls 5, each lid part 2,3, is provided with a depending flange 15. Each depending flange 15 is provided with an aperture 16 and received within the aperture 16 is a plug 17. The plug 17 has a portion 18 which projects inwardly of the depending flange 15. The inwardly projecting portion 18, as can be seen in FIG. 3, is received within the channel 9 defined by the flanges 10 and 11.

It is to be appreciated, therefore, that the lid part 2 is connected by means of plugs 17 provided at each end of the container to the channel 11 provided at each end of the container. The plug 17 acts as a pivot point allowing the lid to pivot about a substantially horizontal axis. Also each plug 17 may slide along the channel 9 into which the portion 18 of the plug 17 projects, and consequently the plugs form a hinging arrangement where the axis of pivotal movement can be located adjustably.

Figure 4:
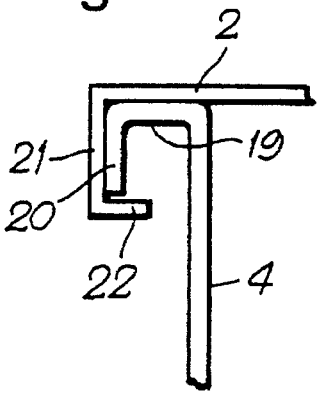
FIG. 4 is a sectional view illustrating the engagement between the edge of the lid and the edge of the box when the lid is in the closed condition.

Reference is now made to FIG. 4 which illustrates the top part of the side wall 4 of the container illustrating that the side wall 4 is provided, at its upper edge, with an outwardly extending flange portion 19 which carries a terminal depending flange portion 20. The lid portion 2 can be seen to carry, at its terminal edge, a depending flange 21, that flange carrying an inwardly turned lip 22.

When the box is in the closed condition, as illustrated in FIG. 1 and FIG. 4, the two lid portions 2,3 extend across the top of the box, thus closing the box. The plugs 17 are located in the depressed central region 12 of each channel 9 provided on the end walls 5 of the box, and as can be seen from FIG. 4, the inwardly directed lip carried by the depending side flange 21 of the lid portion 2 is located immediately under the depending flange 20 carried at the top of the side wall 4.

When the box is to be moved to the open condition, the two lid parts are moved away from each other in a horizontal direction. The lip 22 carried by the lid 2 thus becomes disengaged from the depending flange 20 carried by the side wall 4. The plugs 17 move out of the depressed region 12 of the horizontally extending channel 9, and can move to the very ends of the horizontal extending channel 9. These ends are located above the side walls 4. The lid portions may then be hinged to lie substantially vertically adjacent the sides of the container.

Having now described the broad construction and method of operation of the container, various further structural features will be described as their significance and importance will now be more readily understood.

Figure 5:
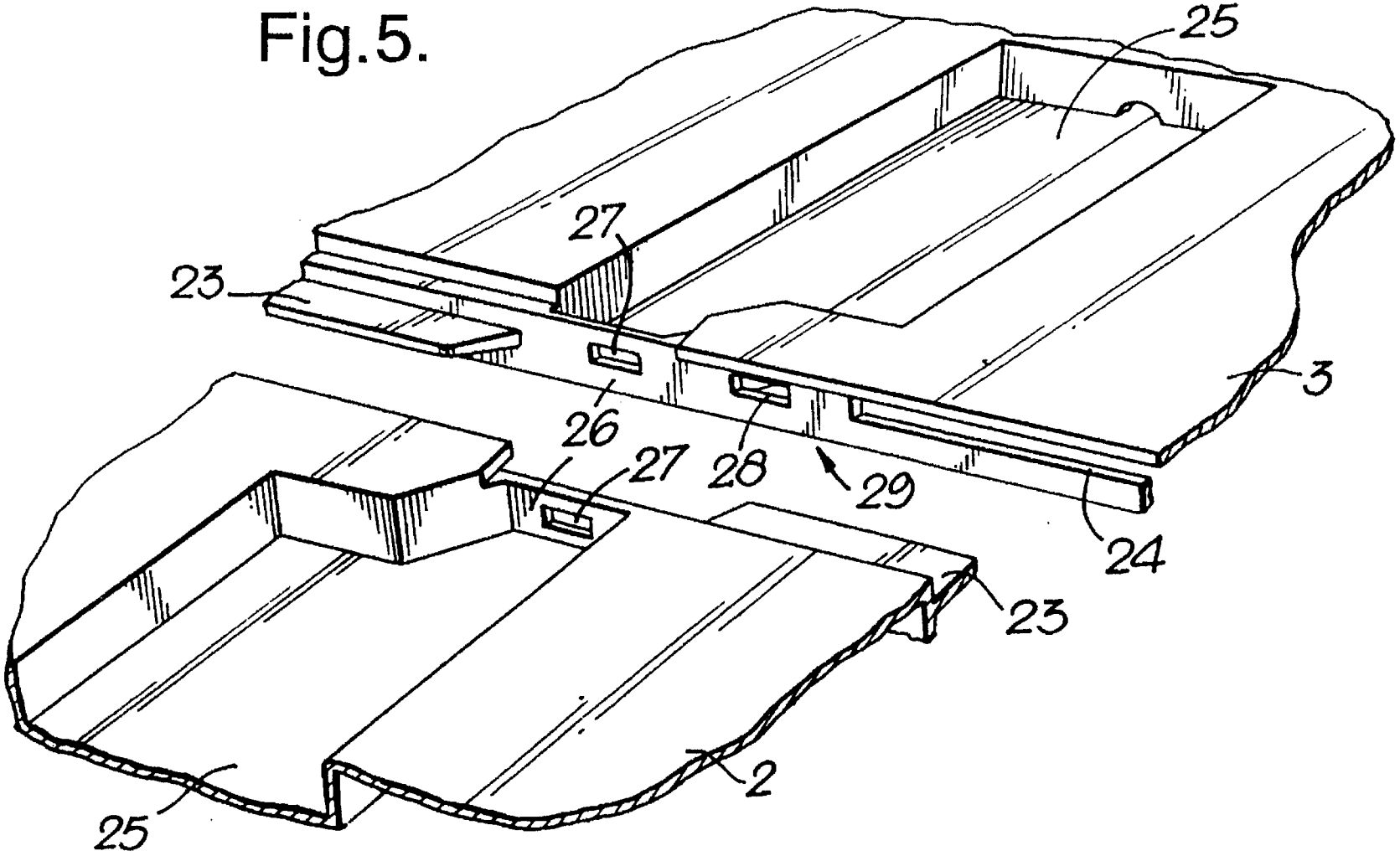
FIG. 5 is an enlarged view of the centre part of the lid showing the lid almost in the closed condition.

As can be seen from FIG. 1 and 5, in the region where the lid part 2 abuts the lid part 3 when the lid is closed, one-half of the lid part 2 is provided with a projecting flange 23 which extends in a plane substantially parallel to the plane of the region 13 of the lid, and the co-operating lid part 3 is provided with a slot 24 adapted to receive the flange when the lid parts are in the closed position. Of course, the described flange and slot are provided adjacent one end wall 5 of the box but a corresponding flange and slot are provided adjacent the other end wall of the box since the box is, in all respects, symmetrical.

It will thus be appreciated that when the lid is in the closed condition the flanges 23 are received in the slots 24, and the inwardly directed lips 22 provided on the lid portions 2,3 are received under the depending flanges 20 provided on the side walls 4, thus making it impossible to obtain access to the interior of the box without moving the lid portions substantially. Of course, the plugs 18 are engaged within the channels 9 thus also serving to retain the lid portions in position.

In the described embodiment of the invention, means are provided to enable security fastening means to be used to secure the lid portions together.

Referring to FIG. 5 it can be seen that each lid portion 2,3 has a generally rectangular recess 25 formed in the upper surface thereof extending transversely across the mid part of the lid portion. Each recess 25 terminates in a vertical wall 26, being part of the wall that defines the slot 24. Thus, as can be seen from FIG. 5, when the lid is in the closed condition, the walls 26 abut each other. Each wall 26 is provided with two apertures 27,28 therein, and when the walls abut each other the apertures 27 abut with the apertures 28.

Each aperture 27 communicates directly with the recess 25 which is open and accessible from the top of the container. Each aperture 28 extends through a region of the wall 26 which does not actually bound the recess 25, but instead communicates with a chamber 29 accessible only from the interior of the box when the lid is closed.

When the lid has been closed a fastening element may be inserted through one of the apertures 27, thus passing through the aperture 28 into the chamber 29. The end of the fastening element within the chamber 29 may then expand to prevent the fastening element from being withdrawn from the aligned apertures 27,28. There is no ready access to the end of the fastening element within the chamber 29, so the only way that the box can be opened is by breaking the fastening element. If the box has been opened after having been sealed in the manner described above, the fact that the box has been opened is readily ascertainable.

It is thus to be appreciated that in the described embodiment the lid of the container is secured in the closed condition by securing means located substantially centrally of the lid.

Figure 2:
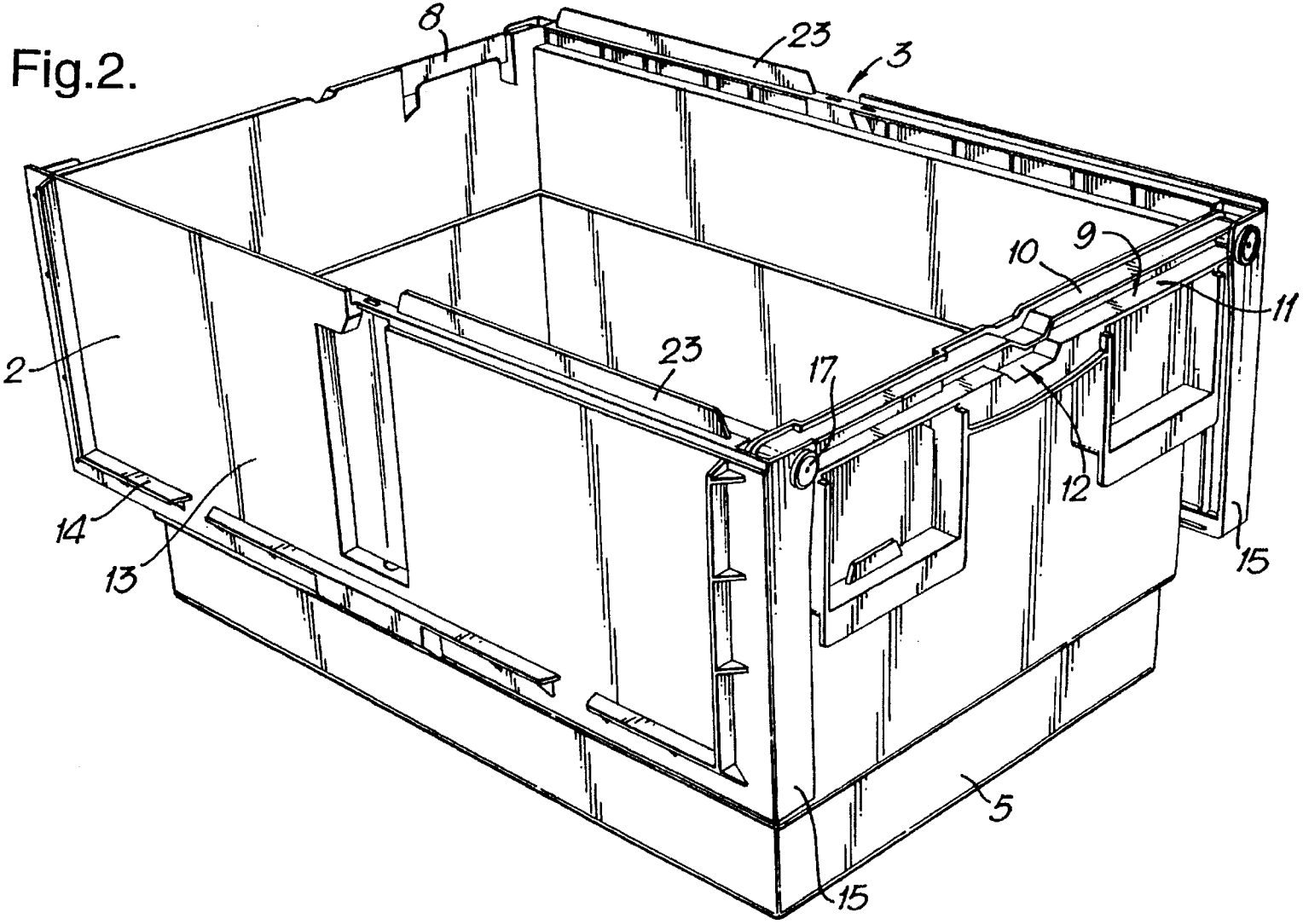
FIG. 2 is a perspective view, corresponding to FIG. 1, showing the lid open.

It is to be noted that when the lid portions 2,3 are in the opened condition as illustrated in FIG. 2, the tongues 23 extend vertically upwardly. It is also to be noted that each lid portion 2,3 has, in the flange 21, a slot 30 (see FIG. 1) substantially aligned with the tongue 23. It will be understood that when two boxes with their lids in the open condition as illustrated in FIG. 2 are nested one in the other, as the upper box is lowered down into the lower box the slot 30 in the lid portion 2 of the upper box will receive the upwardly projecting tongue 23 provided on the portion 2 of the lower box, and a similar effect will be achieved with an identical tongue and slot on the lid portions 3. Thus, in a nested stack of boxes, the lids are secured to each other against rattling.

It is to be understood that when the boxes have their lids closed, as shown in FIG. 1, and are stacked, because the plugs 17 are received in the downwardly recessed region 12 of the channel 9, there is no tendency for the lids to move laterally towards the open position.

What is claimed is:

1. A container comprising a box having a base, upstanding side and end walls defining an open top, and a lid mounted on the box, the lid being movable between a closed position in which the lid covers the open top of the box, and an open position, in which the lid is moved from the open top of the box to provide access to the interior of the box, the lid comprising two substantially identical lid portions, each lid portion being mounted on the box by hinge means to enable the lid to pivot about an axis defined by the hinge means, the hinge means being movable relative to the box to permit sliding movement of each lid portion relative to the box, the lid portions being adapted to be moved in a position in which the lid portions abut one another, means being provided for securing the lid portions together in the abutting condition.

2. A container according to claim 1 wherein each lid portion is provided with means which, when the lid is in the closed condition, engage co-operating means provided at the top of each side of the box to retain the lid in position.

3. A container according to claim 2 wherein each lid portion is provided, at a position which is adjacent a side wall of the box where the lid is in the closed condition, with a depending flange, the depending flange carrying an inwardly directed lip, and each side wall is provided, in its upper region, with a horizontally outwardly extending flange carrying a depending flange, the lip on the lid being adapted substantially to engage the depending flange on the side wall when the lid is in the closed condition.

4. A container according to claim 1 wherein the means to secure the lid portions together comprise means on each lid portion defining an aperture adapted to be co-aligned with a substantially corresponding aperture provided on the other lid portion, the aperture on one lid portion being accessible from the exterior of the container when the lids are in the closed condition, the aperture on the other lid portion only being accessible from the interior of the container when the lids are in the closed condition, the aligned apertures being adapted to receive securing means.

5. A container according to claim 1 wherein each lid portion is provided with a projecting tongue and is also provided with a slot, the projecting tongue on each lid portion being adapted to be received within the slot on the other lid portion when the lid is in the closed condition.

6. A container according to claim 5 wherein each lid portion is provided, at a position opposed to the said projecting tongue, with a slot in the depending flange provided at a position adjacent the side wall of the box when the lid is in the closed condition, the arrangement being such that when the lid of the box is fully open, the lid portions hang substantially vertically adjacent the side walls of the box and if one box is nested into a lower box, the said slot formed in the depending flange of the lid of the one box receives the corresponding tongue of the corresponding lid portion of the lower box.

7. A container according claim 1 wherein the said hinge elements comprise inwardly projecting means provided on a depending flange provided at each end of each lid portion, the projecting means being received in a transversely extending channel formed in an upper region of the end wall of the box.

8. A container according to claim 7 wherein the transversely extending channel has a depressed central region.

9. A container according to claim 1 wherein an upstanding wall is provided on the upper part of each lid portion, the upstanding walls on the lid portions defining, when the lids are closed, an area corresponding to the area of the base of the box.

* * * * *